United States Patent [19]

Bertini

[11] 4,433,842

[45] Feb. 28, 1984

[54] TARGET PIGEON

[76] Inventor: Millo Bertini, 679 Garden St., Trumbull, Conn. 06611

[21] Appl. No.: 228,088

[22] Filed: Jan. 26, 1981

[51] Int. Cl.[3] ..... F41J 9/16

[52] U.S. Cl. ..... 273/363; 273/365

[58] Field of Search ..... 273/364, 365, 363; 46/82–84

[56] References Cited

U.S. PATENT DOCUMENTS

| | | | |
|---|---|---|---|
| 152,101 | 6/1874 | Glahn | 273/365 |
| 248,362 | 10/1881 | Spangler | 273/365 |
| 326,664 | 9/1885 | Macomber | 273/365 |
| 957,742 | 5/1910 | Chiantore | 273/363 |
| 1,368,176 | 2/1921 | McMillan | 273/365 |
| 1,369,830 | 3/1921 | Mitchell | 273/363 |
| 2,058,289 | 10/1936 | Bauman | 273/364 |
| 3,176,988 | 4/1965 | Ferdinando | 273/365 |
| 4,206,919 | 6/1980 | Rovere | 273/365 X |
| 4,218,061 | 8/1980 | Rovere | 273/365 X |
| 4,335,882 | 6/1982 | Rovere | 273/363 |
| 4,352,496 | 10/1982 | Rovere | 273/363 |

FOREIGN PATENT DOCUMENTS

| | | | |
|---|---|---|---|
| 687941 | 6/1964 | Canada | 273/363 |
| 2100107 | 7/1972 | Fed. Rep. of Germany | 273/365 |

*Primary Examiner*—George J. Marlo

*Attorney, Agent, or Firm*—Arthur T. Fattibene

[57] ABSTRACT

An improved target pigeon for simulating the erratic and unpredictable flight of a flushed bird for target shooting which includes a wing member and a detachable cap member. The wing member is provided with blanked out tabs and the cap member is dome shaped and formed of relative thin material wherein the spacing between tabs and the outer diameter of the cap member is such that the cap member is maintained to the wing member under compression and which cap member is provided with a notched flange portion for accommodating the tabs to prohibit relative rotation therebetween and resulting spin off during a launching operation; and which cap member is rendered readily detachable upon a hit when shot at.

12 Claims, 7 Drawing Figures

FIG. 1
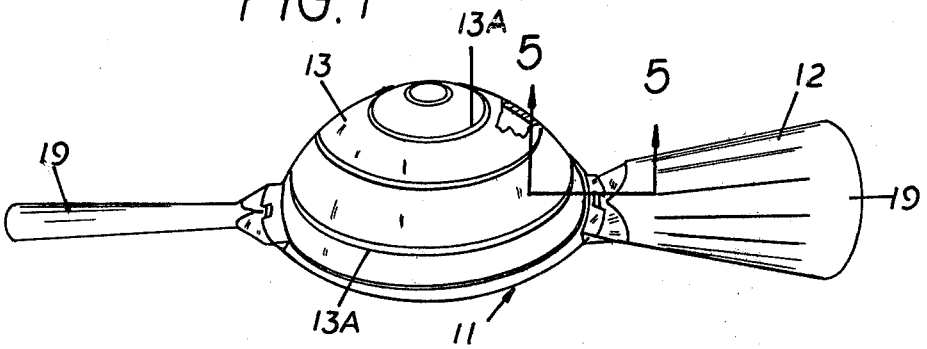
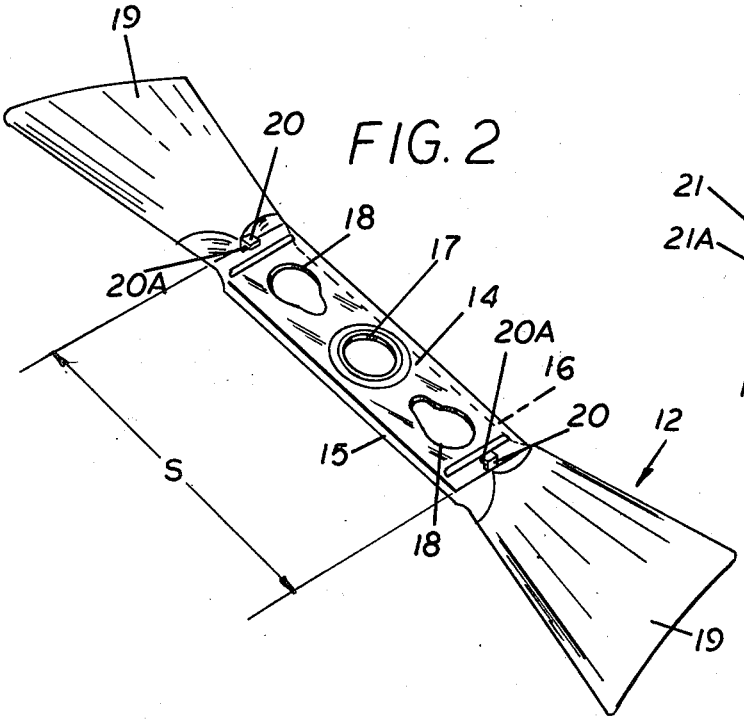
FIG. 2
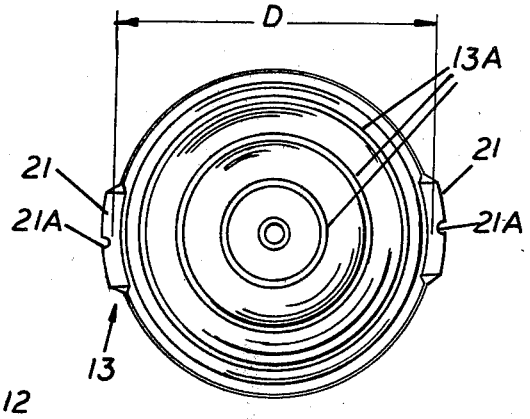
FIG. 4
FIG. 5
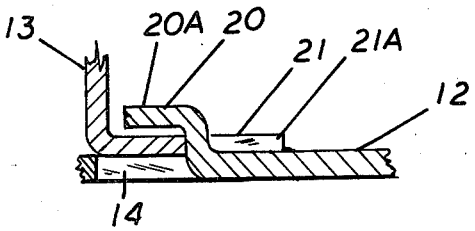
FIG. 3
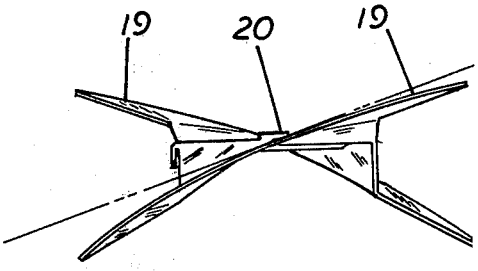

TARGET PIGEON

PROBLEM AND PRIOR ART

Target shooting of the skeet type of shooting generally involved the use of disk shape targets, commonly referred to as "clay pigeons" which are "scaled" or "toss" into the air by a suitable launching device so as to simulate a bird in flight. However, such known "clay pigeon" type targets followed a smooth and regular or predictable type of flight pattern which within a short time proved to be a relatively easy target, and therefor did not provide the shooter with the timing and/or reflexes necessary to hit an object having an erractic or unpredictable trajectory such as a flushed bird, or one which would dip or dive in an unpredictable manner during flight.

The prior art discloses a target pigeon having a generally flat web formed entirely of sheet metal with a central through going hole at the web axis. This target pigeon has diametrically opposite web ends from each of which extends a sheet metal wing which is tipped propeller fashion relative to the other wing. In addition each of the web ends has a respective substantially straight, axially projecting, and outwardly tipped metal tab of V-section. A cup-shaped witness cap entirely of sheet metal is fittable to this web and has a circular rim centered on a cap axis and having a pair of diametrically opposite and radially outwardly extending lips each of which is formed with a respective throughgoing aperture through which the tabs project to hold the cap releasably in place on the web. Such a target pigeon is used for shooting practice, when launched by a prior art machine. This launcher rotates the target pigeon about an axis perpendicular to its wings and extending through the center of the pigeon, so that the wings tipped propeller-fashion relative to each other generate a backwardly moving air stream. Once released by the launcher, such a target pigeon will fly axially forwardly off the launch head on which it is held. This launcher in turn is normally provided with a laterally projecting beak that turns with the head and that deflects the pigeon laterally so that as it flies off the launching machine it will follow an erratic trajectory closely resembling that of a flushed bird.

However, such known "wing type pigeons" had certain inherent disadvantages which caused considerable problems in use. The problems noted with the prior known constructions was that the manner by which the cap was detachably connected to the wing member did not insure reliable operation. Frequently, the cap member was too rigidly secured to the wing which prohibit separation even when hit. In other instances, if the cap was too loosely connected to the wing the cap would tend to separate before launch and/or during flight without a hit. In either instance, the targets of known construction proved unreliable and unsuitable. Another objection to the known "wing target" constructions was they were relatively costly to make and impractical in use. One reason for this is attributed to the fact that the prior known wing pigeon targets were fabricated by all sheet metal parts and/or expensive injected molded plastic parts.

OBJECTS

An object of this invention is to provide for a positive reliable and economical type of "wing target pigeon" capable of simulating an erratic and unpredictable flight trajectory.

Another object is to provide a "wing type target pigeon" having a readily releasable cap which will positively adhere to the wing member during launch and in flight, and which will positively separate when hit.

Another object is to provide a wing type target pigeon which is formed in part from a rigid, re-usable material and in part from a readily inexpensive, expendible material.

BRIEF SUMMARY OF THE INVENTION

The foregoing objects and other features and advantages are attained by a wing type target pigeon comprising a wing member and releasable cap member. The wing member includes an elongated mounting portion having extended wing portions which are oppositely twisted to define a propeller type air foil. The mounting portion is provided with a central opening and opposed drive openings by which it is readily fitted to the rotating hub of a known launching device. The mounting portion is also provided with a pair of blank out tabs for releasably connecting thereto a witness cap. The cap is formed of a light weight readily expendible material with radially extending flanges which are retained in a releasable manner between the blank out retaining tabs. The arrangement is such that the inherent resiliency of the cap together with the tab construction releasably retains the cap to the wing member in a positive manner whereby separation occurs only when a "hit" is made on the target when in flight. The flanges of the cap are also provided with notches to complement the width of the tabs so as to prohibit relative rotation of the cap relative to the wing portion during launching or when in flight.

FEATURES

A feature of this invention resides in the provision of a wing type pigeon target having a wing member formed of a rigid re-useable type of material and a readily releasable cap portion formed of a relatively inexpensive and readily expendible material.

Another feature resides in the provision of releasably securing the cap to the wing member in a positive manner whereby positive separation occurs only when hit as intended.

Another feature resides in the provision of making the cap of a suitable light weight expendible plastic material in which the inherent elasticity of the cap configuration co-acts with tabs formed on the wing member to releasably secure the cap to the wing member in a positive and reliable manner.

Another features resides in providing the cap flanges with notches to accommodate the retaining tabs so as to prohibit relative rotation between the cap and the wing member.

Other features and advantages will become more readily apparent when considered in view of the drawings and detailed description.

IN THE DRAWINGS

FIG. 1 is a perspective view of a wing type target pigeon embodying the invention with portions broken away.

FIG. 2 is a detail perspective view of the wing member without the cap.

FIG. 3 is an end view of the wing member of FIG. 2.

FIG. 4 is a top plan view of the cap member.

FIG. 5 is a detail sectional view taken along line 5—5 on FIG. 1.

DETAIL DESCRIPTION

Figure 6:
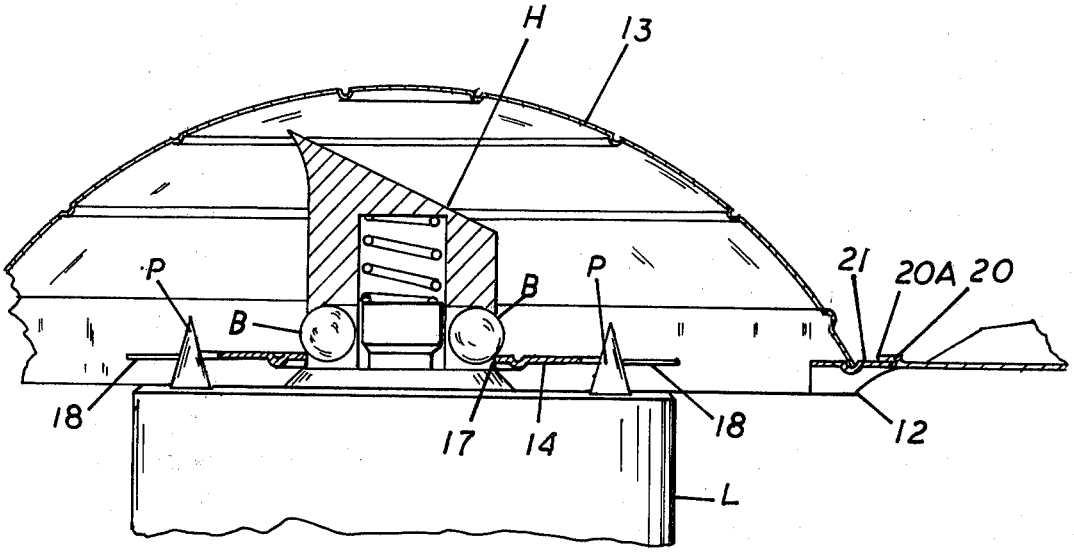
FIG. 6 is a side section view illustrating the target attached to a launcher.
Figure 7:
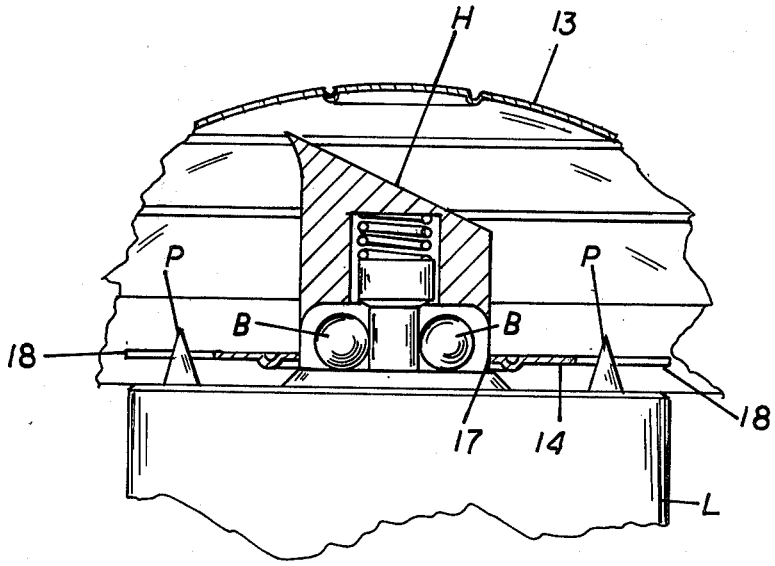
FIG. 7 is a side section view showing the parts prior to launching.

Referring to the drawings, there is shown an improved wing type target pigeon 11 which is adapted to simulate the erratic and unpredictable flight of a flushed bird, and which target can be used in practice and/or in sport shooting. The target pigeon 11 may also be used in conjunction with other types of launchers such as disclosed in U.S. Pat. No. 4,077,384. As best seen in FIG. 1, the target pigeon 11 comprises of a wing member 12 and a witness cap member 13.

The wing member 12 is preferrably formed of a rigid material of sufficient durability so as to be rendered re-usable or not readily destructable. Metal or very rigid or durable plastic may be used to fabricate the wing member 12. However, if it is desired that it be made expendible, it could be made of a lesser durable material. The wing member 12 includes an elongated mounting portion 14 formed of flat sheet material, e.g. sheet metal having downwardly turned longitudinally extending flanges 15 and 16 along the longitudinal edges thereof. The depending flanges 15 and 16 enhances the rigidity of the mounting portion 14.

Centrally disposed in the mounting portion 14 is a hole or opening 17 which is adapted to receive the rotating hub H of a launching device L. Disposed to either side of the central opening 17 is another opening 18—18 adapted to receive the driving pins P associated with the head of the launching device L. The target pigeon 11 is detachably connected to the hub H of the launcher L by retainer balls B in a manner described in my above mentioned co-pending application. The opposed ends of the mounting portion 14 have connected thereto or extended, as shown, wing portions 19—19 which are oppositely twisted to define a propeller type air foil. The sides of the wing portions 19—19 flare outwardly as shown, and the respective wing portions 19—19 are arcuately curved in cross-section as best seen in FIG. 3. The entire wing member 12 can be formed as an integral unit; and can be readily stamped and formed of sheet metal and/or injected molded or otherwise formed of plastic.

Adjacent to the ends of the mounting portion 14, a pair of retaining tabs 20—20 are blanked out of the plane or material of the mounting portion 14. As best seen in FIGS. 2 and 5, the tab 20 is blanked out of the plate defining the mounting portion so the free end 20A of the tab is spaced slightly from the plane surface of the mounting portion 14. Also, the free ends 20A of the respective tabs 20 are directed toward one another. In accordance with this invention and as will be hereinafter defined, the spacing or distance S between tabs 20—20 is slightly less than the diameter D of the cap 13.

Detachably secured to the wing member 12 between the retaining tabs 20—20 is the witness cap 13. The cap 13 as shown is in dome shape or cup shape and which is formed of a very thin, light weight material which has an inherent resiliency or spring like action causing the member to assume its normal expanded state as shown in FIG. 4. For this purpose a thin, light weight, plastic material may be used, and cap 13 may be readily formed by a vacuum forming method.

As shown, the outer periphery of the cap is formed with a diameter D which is greater than the distance S between tabs 20. Projecting radially or laterally outwardly from the outer periphery of the cap are a pair of opposed flanges 21,21. The flanges 21,21 in the assembled position of the cap 13 and wing 12 are arranged to slide under the free ends 20A of the respective tabs 20 as seen in FIGS. 1 and 5. To achieve this, it will be noted that the dome or cap 13 must be slightly squeezed so that the edge of the flanges can be positioned beneath the free ends 20A of the tabs 20. Upon release of the slight squeezing force on cap 13, the inherent resiliency of the cap causes the flanges 21 to be urged in frictional holding positions relation to tabs 20 to form a positive releasable coupling between the cap 13 and its wing member 12.

To prohibit any relative rotation between the cap 13 and the wing member 12, the respective flanges 21 are each provided with a notch 21 A having a width to accommodate the width of the associated tab 20. Thus, the sides of notches 21A straddle the sides of the associated tab 20 and thereby prohibits any relative lateral displacement between the cap 13 and the wing member 12.

The target pigeon 11 thus described provides an arrangement whereby the cap 13 can be readily assembled to the wing member 12. Also, the manner by which the cap 13 is mechanically and frictionally retained to the wing enables the target to be readily positioned on a suitable launcher and rotated to the desired launching R.P.M. without danger of the cap 13 becoming dislodged prior to launch. Also, the releasable connection as described is such that the cap 13 is rendered readily disengagable from the wing 12 by the slightest "hit" when in flight. Accordingly, the targets 11, as described, are rendered more positive in operation as the false indications relative to hits and non-hits are virtually avoided.

To enhance the resiliency of the cap 13, a series of circumscribing ridges 13A may be formed on the cap 13. As noted, the wing member 12 when fabricated of metal can be re-used. The cap 13 being made of light weight and inexpensive plastic is readily expendible.

While the target pigeon has been described with respect to a particular embodiment thereof, it will be readily appreciated and understood that variations and modifications may be made without departing from the spirit or scope of the invention.

What is claimed is:

1. A target pigeon for simulating the flight of a flushed bird having an erratic and unpredictable flight trajectory comprising a wing member and a cap member, said wing member being formed of a rigid reusable material and includes an elongated flat mounting portion having down turned flanges extending along the longitudinal edges of said mounting portion, and wing sections connected to the opposed ends of said mounting portions; said wing sections being oppositely twisted to define a propeller shaped air foil section, said mounting portion having a central opening adapted to receive a rotating hub of a launching device, a drive opening disposed to either side of said central opening adaptable for accommodating the drive pins of a launcher, readily releaseable securing means for detachably securing said cap member to said mounting portion of said wing member, said releaseable securing means including a pair of oppositely disposed tabs blanked out of the plane of said mounting portion, said tabs having their respective free ends spaced slightly out of and above the plane of said mounting portion and having their respective free ends directed toward one another in a spaced plane generally parallel of said mounting portion, said cap member having a dome shaped portion formed of a relatively thin, flexible, inherently resilient material, said dome shaped portion having opposed laterally extending flange portions oppositely disposed about the outer periphery of said dome shaped portion and extending radially thereof, the lateral spacing between said tabs being slightly less than the free diameter of said dome shaped portion whereby said dome shaped portion is slightly compressed to secure and maintain said flange portions between said tabs, said tabs projecting over said flange portion for retaining said cap member to said wing member, and said flange portions each having a notch formed therein for accommodating the width of said tab so as to prohibit relative rotation between said cap member and said wing member during a launching operation and/or in flight.

2. A target pigeon comprising a wing member and a dome shaped witness cap, and means for detachably securing said cap to said wing member, said cap being formed of a relatively thin, light weight, flexible material, and said detachable securing means including complementary blanked out portions formed on said wing member and said cap, which are adapted to mate so as to positively retain said cap to said wing member during launching and during flight and which cap, upon contact by shot, will readily separate from the wing member to indicate a hit, said wing member including an intermediate elongated flat mounting portion having a central opening arranged to receive the rotating head of a launching device, and a drive opening disposed to one side of said central opening for receiving a driving pin in the rotating hub of a launching device, and a wing portion connected to the opposed ends of said mounting portion, each of said wing portions being oppositely twisted to define a propeller shaped wing foil section, and said securing means including a tab blanked out of the plane of said mounting portion adjacent the respective ends thereof, said blanked out tabs being oppositely disposed and directed toward each other, and spaced above the plane of said mounting portion, and said cap having oppositely disposed flanges projecting radially beyond the periphery of said cap, said flanges being each provided with a notch adapted to slide under and be received between said oppositely disposed tabs for releasably securing said cap to said wing member, whereby said notch straddles its adjacent tab so as to prohibit relative rotation between said cap and said wing member during a launching and in flight, and wherein the lateral spacing between the opposed tabs is slightly less than the spacing between opposed edges of said cap so that said cap is required to be slightly compressed to be received and retained between said opposed tabs, and said cap being formed of a material having an inherent resiliency having a tendency to assume its normal uncompressed state wherein said inherent resiliency of said compressed cap functions to maintain said cap releasably retained in a positive manner to said wing member between said tabs during launch and in flight until hit.

3. A target pigeon as defined in claim 2 wherein said cap is formed of a relatively thin plastic material capable of being vacuum formed.

4. A target pigeon comprising a generally flat web formed at a web axis with a central throughgoing hole and having a pair of diametrically opposite ends;

a pair of vanes on said web extending diametrically oppositely from said ends thereof and tipped propeller-fashion to each other;

a pair of diametrically opposite holding tabs on said ends of said webs directed generally axially and tipped inwardly toward each other, said vanes, web, and tabs being integrally formed and together having a predetermined relatively great mass; and a cup-shaped witness cap having an axially directed and substantially circular annular rim centered on a cap axis and formed with a pair of diametrically opposite outwardly open notches, said rim being axially engageable with said ends of said web inwardly of said tabs with said tabs fitting in said notches, said cap having a predetermined relatively small mass relative to said great mass.

5. The target pigeon defined in claim 4 wherein said web is of a predetermined maximum width measured in a plane perpendicular to said web axis, said cap being fully exposed at arcuate sections diametrically flanking said web when engaged with said tabs.

6. The target pigeon defined in claim 5 wherein said web has a substantially planar upper surface engaging said rim of said cap, said tabs standing up from said upper surface.

7. The target pigeon defined in claim 6 wherein said web, vanes, and tabs are integrally made of metal and said cap is made of a synthetic resin.

8. The target pigeon defined in claim 7 wherein said cap has when not engaged with said tabs a predetermined length dimension between the bases of said notches which is longer than the diametrical distance between said tabs, said cap being limited by elastically deformable and compressed diametrically when engaged between said tabs.

9. The target pigeon defined in claim 6 wherein said cap has a pair of diametrically opposite and radically outwardly projecting lips formed with said notches, said cap being substantially rotation symmetrical about said cap axis except for said lips and notches.

10. The target pigeon defined in claim 9 wherein said cap is part spherical except for said lips and notches.

11. The target pigeon defined in claim 10 wherein said cap is formed with a plurality of axially spaced annular rigidifying grooves lying in respective planes perpendicular to said cap axis.

12. The target pigeon defined in claim 6 wherein said web has a pair of generally parallel secantally extending edges each formed with a bend-down stiffening flange, said arcuate sections being defined by said secant edges.

* * * * *